US008821067B1

(12) United States Patent
Anderson

(10) Patent No.: US 8,821,067 B1
(45) Date of Patent: Sep. 2, 2014

(54) BOAT LIFT STEP

(71) Applicant: Mark Anderson, Sauk Centre, MN (US)

(72) Inventor: Mark Anderson, Sauk Centre, MN (US)

( * ) Notice: Subject to any disclaimer, the term of this patent is extended or adjusted under 35 U.S.C. 154(b) by 0 days.

(21) Appl. No.: 13/912,554

(22) Filed: Jun. 7, 2013

(51) Int. Cl.
*B63C 3/00* (2006.01)
*E04F 11/09* (2006.01)
*B63C 3/06* (2006.01)

(52) U.S. Cl.
CPC ..... *B63C 3/06* (2013.01)
USPC ..... 405/1; 405/3; 52/177; 52/188

(58) Field of Classification Search
CPC ..... B63C 3/06; B63C 3/12; E04F 11/00; E04F 11/02; E04F 11/022; E04F 11/09; E04F 11/16; E04F 11/17
USPC ..... 405/1, 3; 52/177, 179, 182, 188, 190
See application file for complete search history.

(56) References Cited

U.S. PATENT DOCUMENTS

| | | | | |
|---|---|---|---|---|
| 4,808,028 | A * | 2/1989 | White | 405/3 |
| 4,985,095 | A * | 1/1991 | Riddle | 52/179 |
| 6,554,533 | B2 * | 4/2003 | Godbersen | 405/3 |
| 6,932,021 | B1 | 8/2005 | Martini | |
| 8,297,215 | B1 | 10/2012 | Chinn | |
| 8,356,568 | B1 | 1/2013 | Chinn | |
| 2005/0252720 | A1 * | 11/2005 | Chant et al. | 182/127 |
| 2007/0056102 | A1 * | 3/2007 | Smith | 5/600 |
| 2009/0145059 | A1 * | 6/2009 | Kay | 52/179 |

* cited by examiner

*Primary Examiner* — Frederick L Lagman

(57) ABSTRACT

A step that may be attached to a boat lift rail. The boat lift rail may be in between the dock and the boat. Therefore, a user may board the boat from the dock using the step. Further, the step may raise and lower with the lift with the top of the step staying above the surface of the water.

6 Claims, 4 Drawing Sheets

BOAT LIFT STEP

BACKGROUND OF THE INVENTION

The present invention relates to a boat lift step and, more particularly, to a boat lift step that is bolted to a boat lift rail.

A boat lift is used to dry dock and launch boats. It consists of a structural platform that is lifted and lowered vertical, synchronously by a number of hoists. First, the platform is lowered underwater, then the boat is floated above the support, and finally the platform with the boat is lifted and the boat is brought to the level of the quay.

However, when a boat is mounted on a boat lift, it may be difficult and unsafe for users to mount the boat from the dock. To cope with this difficulty, a strip of sandpaper may be attached to the boat lift rail. However, when the boat is being lowered into the water, the boat lift rail is submerged underwater and therefore the strip of sandpaper no longer helps.

As can be seen, there is a need for a step provided in between the dock and the boat.

SUMMARY OF THE INVENTION

In one aspect of the present invention, an apparatus comprises: a step having a top portion, a bottom portion, and a middle portion, wherein the top portion is substantially flat, wherein the middle portion comprises a step riser; and an attachment component, wherein the attachment component is configured to attach the bottom portion of the step to a boat riser rail.

These and other features, aspects and advantages of the present invention will become better understood with reference to the following drawings, description and claims.

DETAILED DESCRIPTION OF THE INVENTION

Figure 1:
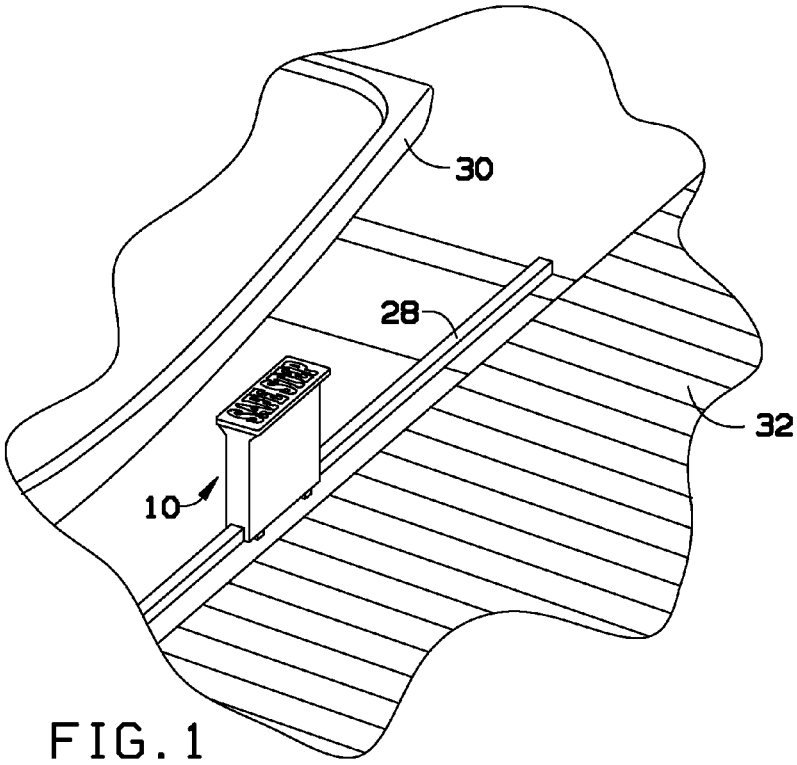
FIG. 1 is a perspective view of the present invention shown in use.
Figure 2:
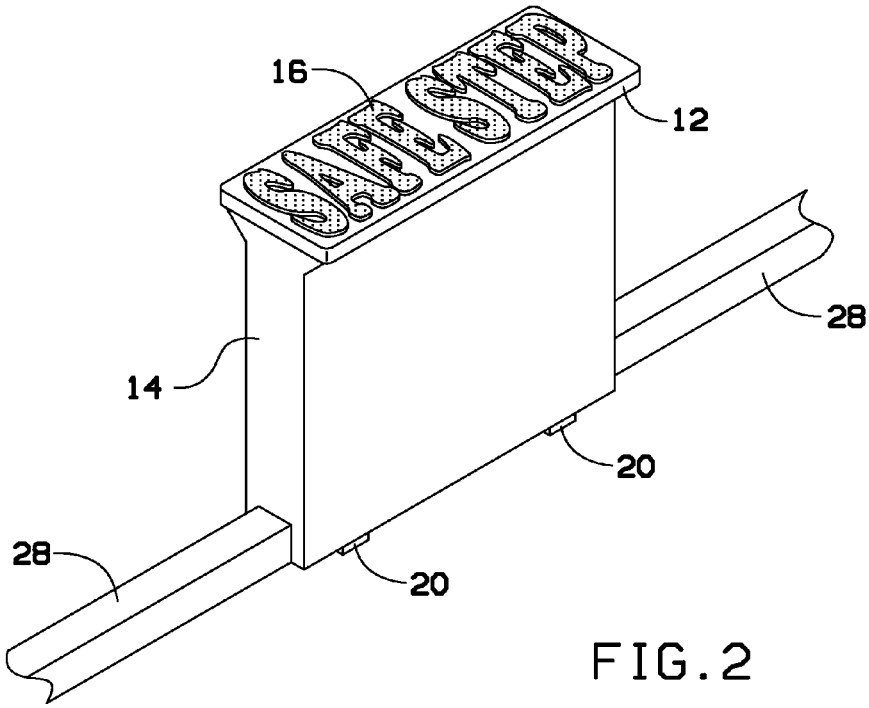
FIG. 2 is a perspective view of the present invention.
Figure 3:
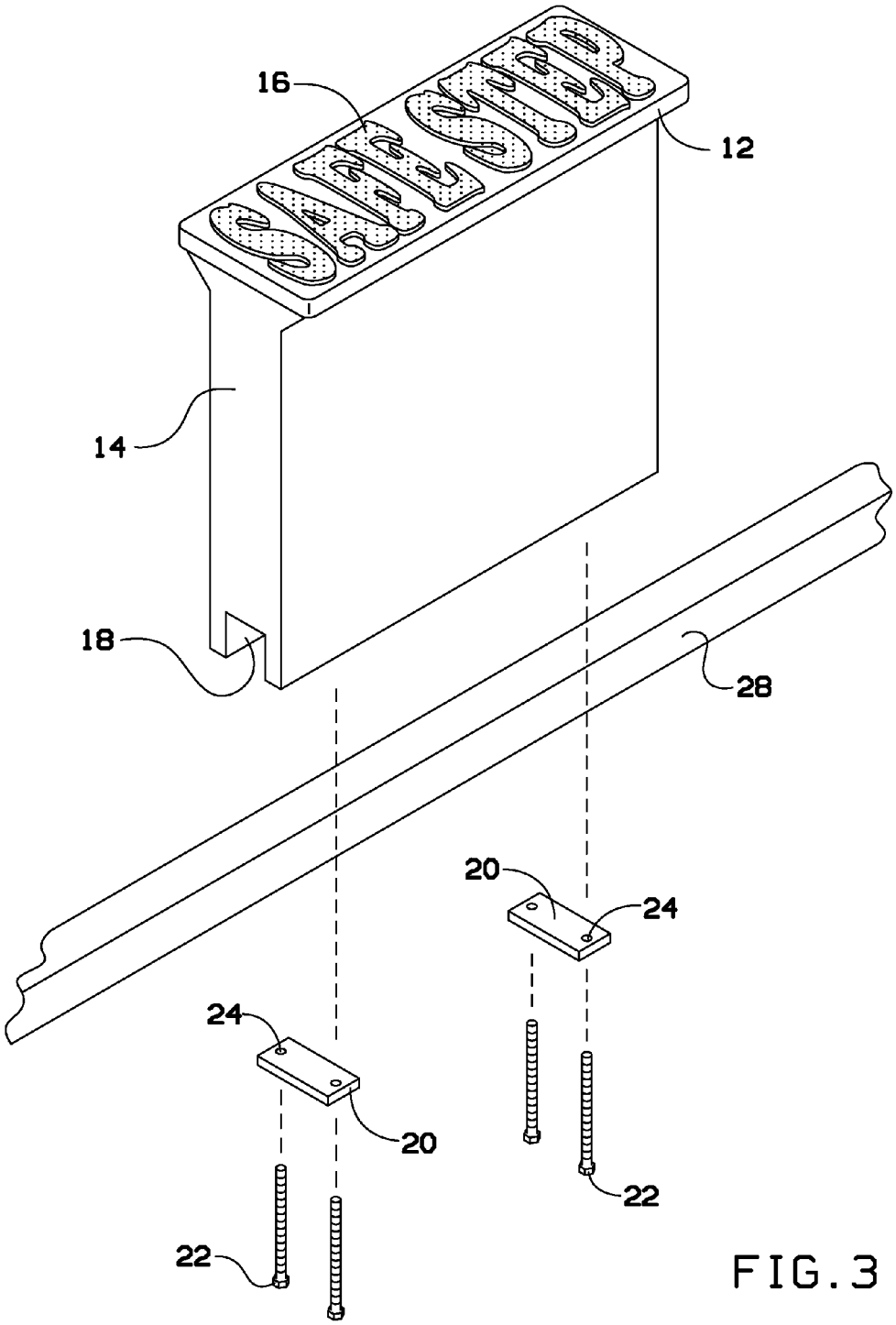
FIG. 3 is a top perspective exploded view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a step that may be attached to a boat lift rail. The boat lift rail may be in between the dock and the boat. Therefore, a user may board the boat from the dock using the step. Further, the step may raise and lower with the lift with the top of the step staying above the surface of the water.

Referring to FIGS. 1 through 5, the present invention may include a step 10. The step 10 may include a top portion 12, a bottom portion 16, and a middle portion 14. The top portion 12 may be substantially flat so that a user may step on the top portion 12 safely. The middle portion 14 may be a step riser. The step riser may have a height so that the top portion 12 of the step may protrude above the surface of the water even when the boat is lowered into the water. For example, the step riser may have a height of around 12 and up to around 30 inches, around 16 and up to around 24 inches, or around 20 inches. The bottom portion 16 may include a first ridge and a second ridge. The first ridge and the second ridge form a channel 18 in between. The boat riser rail 28 may fit within the channel 18.

Figure 4:
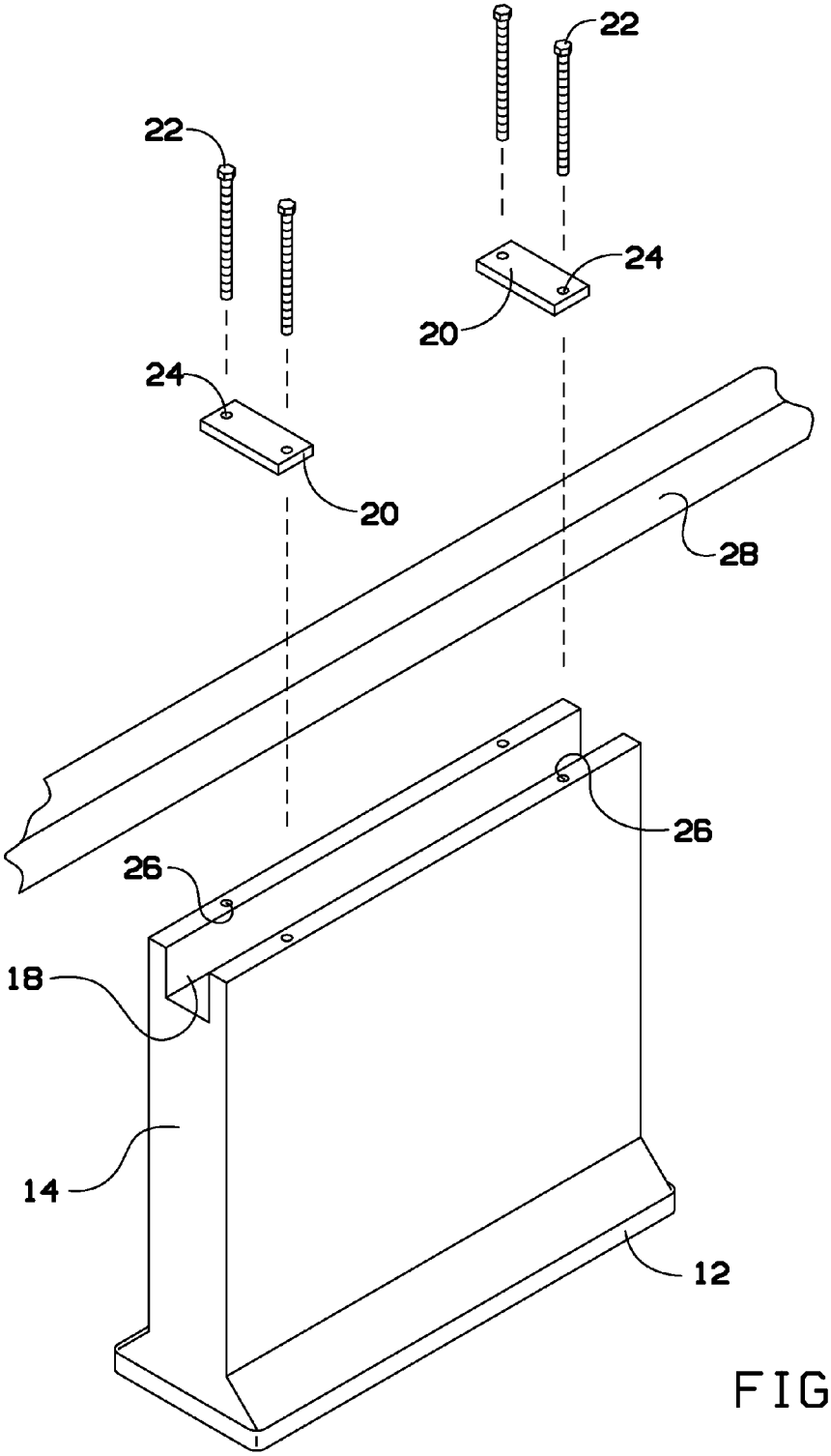
FIG. 4 is a bottom perspective exploded view of the present invention.
Figure 5:
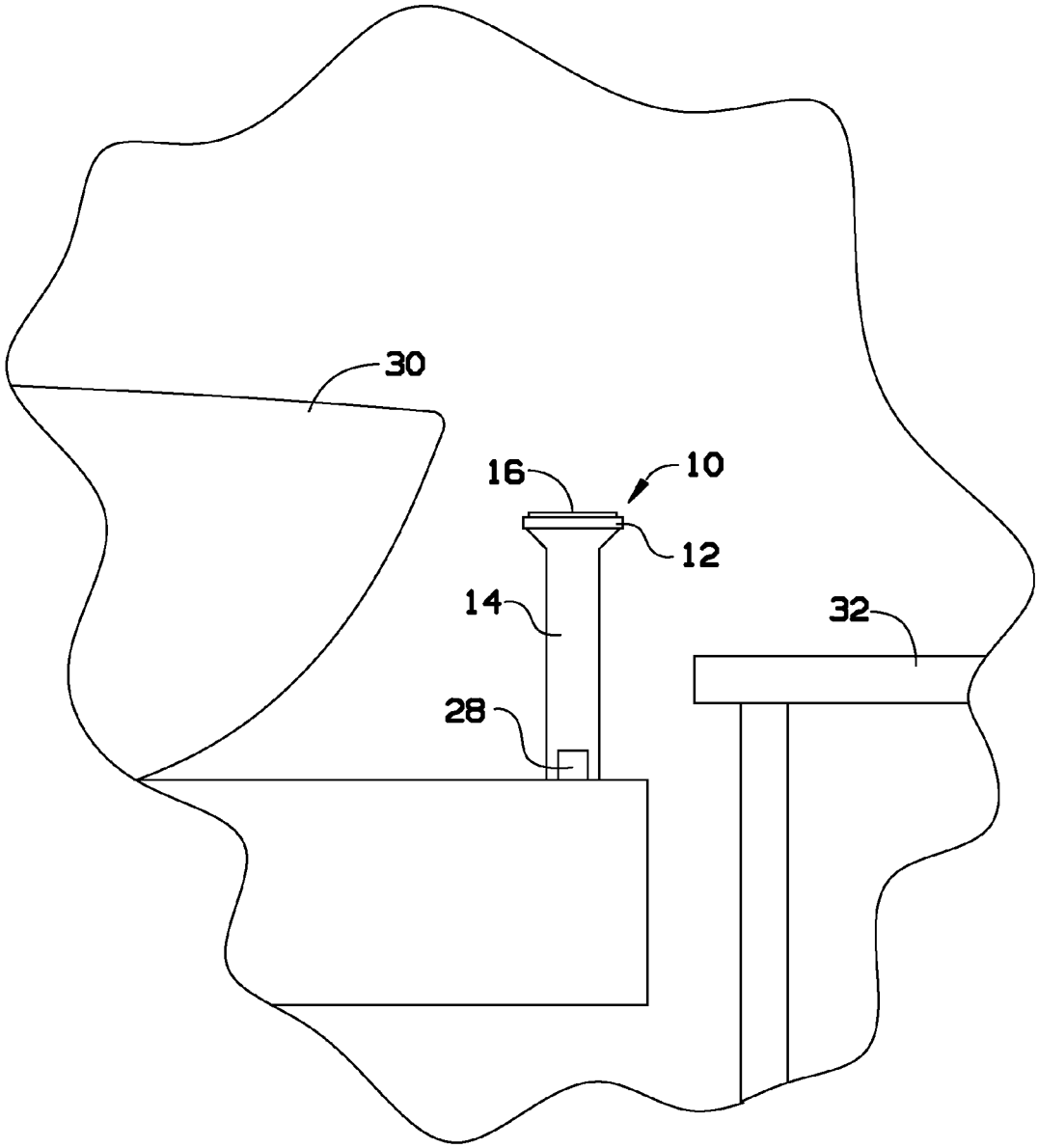
FIG. 5 is a side view of the present invention shown in use.

The present invention may further include an attachment component 34. The attachment component 34 may attach the bottom portion 16 of the step 10 to a boat riser rail 28. In certain embodiments, the attachment component 34 may include at least one bracket 20, such as two brackets 20 as illustrated in FIG. 4. The brackets 20 may include a first side and a second side. The first side may include a first bracket bolt hole 24 and the second side may include a second bracket bolt hole 24. The attachment component 34 may further include at least one bolt 22, such as a first bolt 22 and a second bolt 22. However, the present invention may include four bolts 22 as illustrated in FIG. 4. In certain embodiments, the bottom portion 16 of the step 10 may include step bolt holes 26, such as a first step bolt hole 26 and a second step bolt hole 26.

The bottom portion 16 of the step 10 may be secured to the boat riser rail 28 by placing the bottom portion 16 of the step on a top portion of the boat riser rail 28. The step 10 may be oriented so that the boat riser rail 28 is in between the first step bolt hole 26 and the second step bolt hole 26. In certain embodiments, the bolt holes 26 may be included on the ridges mentioned above. The bracket 24 may be placed on a bottom portion of the boat riser 28, aligning the first step bolt hole 26 with the first bracket bolt hole 24 and the second step bolt hole 26 with the second bracket bolt hole 24. Then the bracket 20 may be bolted to the bottom portion 16 of the step 10 with the bolts 22. Therefore, the boat riser rail 28 is in between the brackets 20 and the step 10, and the step 10 is secured to the boat riser rail 28.

In certain embodiments, the top portion 12 may include a non-skid surface 36. For example, the non-skid surface 36 may include tread. In certain embodiments, the tread may be in the form of words, such as "Safe Step." The non-skid surface 36 may further include sand-paper to further prevent a user from slipping.

As mentioned above, and illustrated in FIG. 5, the step 10 of the present invention may be attached to the boat lift rail 28 to be used to step from a dock 32 to a boat 30. The boat 30 and the boat lift rail 28 may be lowered into the water. However, due to the length of the step riser, the top portion 12 may protrude above the surface of the water. Therefore a user may step onto the step 10 and into the boat 30.

It should be understood, of course, that the foregoing relates to exemplary embodiments of the invention and that modifications may be made without departing from the spirit and scope of the invention as set forth in the following claims.

What is claimed is:

1. An apparatus comprising:

a step having a top portion, a bottom portion, and a middle portion, wherein the top portion is substantially flat, wherein the middle portion comprises a step riser, wherein the bottom portion is a first ridge and a second ridge, wherein the first ridge and the second ridge form a channel in between, and wherein the channel is formed to fit around a boat riser rail; and an attachment component, wherein the attachment component is configured to attach the bottom portion of the step to the boat riser rail.

2. The apparatus of claim 1, wherein the attachment component comprises at least one bolt.

3. The apparatus of claim 1, wherein the attachment components comprises:

at least one bracket having a first side and a second side wherein the first side comprises a first bracket bolt hole and the second side comprises a second bracket bolt hole; and a first bolt and a second bolt, wherein the bottom portion of the step comprises a first step bolt hole and a second step bolt hole, wherein the bottom portion of the step is secured to the boat riser rail by placing the bottom portion of the step on a top portion of the boat riser rail wherein the boat riser rail is in between the first step bolt hole and the second step bolt hole, and placing the at least one bracket on a bottom portion of the boat riser, aligning the first step bolt hole with the first bracket bolt hole and the second step bolt hole with the second bracket bolt hole, and bolting the bracket to the bottom portion of the step through the holes.

4. The apparatus of claim 1, further comprising tread on the top portion of the step.

5. The apparatus of claim 1, further comprising sand paper on the top portion of the step.

6. An apparatus comprising:

a step having a top portion, a bottom portion, and a middle portion, wherein the top portion is substantially flat, wherein the middle portion comprises a step riser; and an attachment component, wherein the attachment component is configured to attach the bottom portion of the step to a boat riser rail, wherein the attachment components comprises: at least one bracket having a first side and a second side wherein the first side comprises a first bracket bolt hole and the second side comprises a second bracket bolt hole; and a first bolt and a second bolt, wherein the bottom portion of the step comprises a first step bolt hole and a second step bolt hole, wherein the bottom portion of the step is secured to the boat riser rail by placing the bottom portion of the step on a top portion of the boat riser rail wherein the boat riser rail is in between the first step bolt hole and the second step bolt hole, and placing the at least one bracket on a bottom portion of the boat riser, aligning the first step bolt hole with the first bracket bolt hole and the second step bolt hole with the second bracket bolt hole, and bolting the bracket to the bottom portion of the step through the holes.

* * * * *